United States Patent [19]

Deguchi et al.

[11] Patent Number: 5,073,293

[45] Date of Patent: Dec. 17, 1991

[54] MILD DETERGENT COMPOSITIONS CONTAINING ALKYLGLYCOSIDE AND DICARBOXYLIC ACID SURFACTANTS

[75] Inventors: Katsuhiko Deguchi; Kozo Saito; Hiroyuki Saijo, all of Utsunomiya, Japan

[73] Assignee: Kao Corporation, Tokyo, Japan

[21] Appl. No.: 404,630

[22] Filed: Sep. 8, 1989

[30] Foreign Application Priority Data

Sep. 20, 1988 [JP] Japan ..... 63-236134

[51] Int. Cl.[5] ..... C11D 3/22; C11D 1/04; C11D 1/52

[52] U.S. Cl. ..... 252/174.17; 252/173; 252/174.19; 252/546; 252/DIG. 5

[58] Field of Search ..... 252/174.17, DIG. 5, 252/DIG. 13, 546, 174.19, 173

[56] References Cited

U.S. PATENT DOCUMENTS

| | | | |
|---|---|---|---|
| 2,878,190 | 3/1959 | Dvorkovitz et al. | 252/152 |
| 3,658,994 | 4/1972 | Kaiser et al. | 424/319 |
| 3,734,859 | 5/1973 | Ward | 252/108 |
| 3,759,847 | 9/1973 | Martineau et al. | 252/544 |
| 4,268,424 | 5/1981 | Hall et al. | 252/546 |
| 4,668,422 | 5/1987 | Malik et al. | 252/174.17 |
| 4,673,525 | 6/1987 | Small et al. | 252/132 |
| 4,863,628 | 9/1989 | Nambudiry | 252/174.19 |
| 4,898,725 | 2/1990 | Hoeffkes et al. | 424/70 |
| 4,976,885 | 12/1990 | Wisotzki et al. | 252/174.17 |

FOREIGN PATENT DOCUMENTS

| | | |
|---|---|---|
| 0280143 | 8/1988 | European Pat. Off. . |
| 62-133000 | 6/1987 | Japan . |
| 1575094 | 9/1980 | United Kingdom . |
| 2049723 | 12/1980 | United Kingdom . |
| 8602943 | 5/1986 | World Int. Prop. O. . |

*Primary Examiner*—Paul Lieberman
*Assistant Examiner*—A. Beadles-Hay
*Attorney, Agent, or Firm*—Oblon, Spivak, McClelland, Maier & Neustadt

[57] ABSTRACT

A low irritant, mild detergent composition is disclosed. The detergent composition comprises, as essential components, (a) alkyl glycoside and (b) a specific type of dicarboxylic acid surface active agent at a specific ratio. The detergent composition is low irritant, has excellent foaming power and detergency, and yet is easily rinsed out and at the same time provides a pleasant feeling to the hands during use. It can be used as laundry detergents, dishwashing detergents, as well as detergents for use with household articles, and hair and body.

5 Claims, No Drawings

MILD DETERGENT COMPOSITIONS CONTAINING ALKYLGLYCOSIDE AND DICARBOXYLIC ACID SURFACTANTS

BACKGROUND OF THE INVENTION

1. Field of the Invention

This invention relates to a detergent composition, and, more particularly, to a detergent composition which is low irritant, giving remarkably reduced damage to hair and skin. The composition has excellent foaming power and detergency, and yet is easily rinsed out and at the same time provides an agreeable sensation to the hands during use.

2. Description of the Background Art

Because of the increased awareness concerning safety of the human body in recent years, a number of attempts have been undertaken to achieve mildness to the skin in the manufacture of laundry detergents, dishwashing detergents, detergents for use with household articles, as well as those for the hair and the body. An example of such attempts is to adjust the pH of detergent compositions to a weakly acidic range, i.e., pH 5–6, which is near the pH of the human skin, thereby obtaining mildness to the skin. Another example is the use of a low irritant detergent base as a major detergent component. Amino acid type or alkylphosphate type surface active agents are used as low irritant detergent bases for this purpose (Japanese Patent Publication Nos. 40125/1975, 426023/1976, 9033/1980, and 27319/1983). Although these surface active agents are low irritant, they have drawbacks such as insufficient foaming power and detergency, poor solubility, and the like when used alone. Sodium alkylbenzenesulfonates have conventionally been used as a detergent base for dishwashing detergent compositions. Although they have excellent detergency, their strong defatting action is liable to cause skin roughening.

For these reasons, sodium alkylethoxysulfates which are less irritant have currently been used as a detergent base for dishwashing detergent compositions. Their use in combination with tertiary amine oxides, higher fatty acid diethanolamides, etc., as auxiliary surface active agents, has promoted various performances, providing dishwashing detergent compositions with reduced irritation to the skin.

In spite of these efforts for producing detergent compositions which are less irritant and mild to the skin, the level of improvement hitherto achieved is not yet satisfactory.

Alkyl glycosides, which are sugar-derived surface active agents, are low irritant, nonionic surface active agents. Even though nonionic in nature, alkyl glycosides not only produce stable foams by themselves but also are known to act as foam stabilizers for anionic surface active agents. Because of this, a great deal of attention has been given to alkyl glycosides in recent years. Japanese Patent Laid-open No. 104625/1983, for example, discloses a foaming surfactant composition comprising an anionic surface active agent and an alkyl glycoside. Japanese Patent Laid-open No. 74999/1987 describes a low irritant liquid detergent composition for kitchen use having superior foaming power and detergency which comprises an alkyl glycoside, an anionic surface active agent, and a fatty acid diethanolamide. These detergent compositions, although exhibiting performances better than conventional detergent compositions using polyoxyethylenealkyl ethers as a major component, are not yet satisfactory, especially in their rinse-out performance and in the sensation which they impart to the hands during washing.

In view of this situation, the present inventors have conducted extensive studies to make the best use of the superior characteristics of alkyl glycosides. As a result, the present inventors found that use of a specific type of dicarboxylic acid surface active agents together with alkyl glycoside compounds lessened the irritation to the skin, promoted detergency and foaming power, and at the same time brought about improved rinse-out performance and better feeling to the hands during washing. Such a finding has led to the completion of the present invention.

SUMMARY OF THE INVENTION

Accordingly, an object of this invention is to provide a detergent composition comprising:

(a) an alkyl glycoside, (b) one or more dicarboxylic acid surface active agents of the following formulae (II), (III), (IV), and (V):

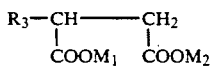

(II)

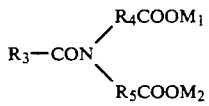

(III)

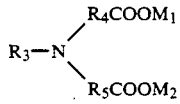

(IV)

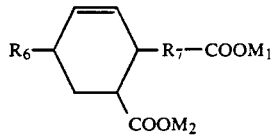

(V)

wherein $R_3$ is a linear or branched, alkyl or alkenyl group having 8–16 carbon atoms, $R_4$ and $R_5$ each individually represents a group $—(CH_2CH_2O)n—(CH_2)m$ (m is a value of 1–5 and n is a value of 0–5), $R_6$ is an alkyl group having 3–12 carbon atoms, $R_7$ is an alkylene group having 1–12 carbon atoms, provided that the total carbon atom content in $R_6$ and $R_7$ groups is 6–22, and $M_1$ and $M_2$ each individually represents a hydrogen atom, an alkali metal, an alkaline earth metal, or an alkanolamine; and wherein the ratio (b)/(a) by weight is 1/600–1/1 and the content of components (a) plus (b) is 1–60% by weight.

In a preferred embodiment of the present invention the alkyl glycoside is a compound represented by the following formula (I):

$$R_1(OR_2)xGy \qquad (I)$$

wherein $R_1$ is a linear or branched, alkyl, alkenyl, or alkylphenyl group having 8–18 carbon atoms, $R_2$ is an alkylene group having 2–4 carbon atoms, G is a residual group of a reducing sugar having 5–6 carbon atoms, x is a mean value of 0–5, and y is a mean value of 1–10.

Other objects, features and advantages of the invention will hereinafter become more readily apparent from the following description.

DETAILED DESCRIPTION OF THE INVENTION AND PREFERRED EMBODIMENTS

Alkyl glycoside, the (a) component, is used as a major detergent component in the composition of the present invention. A desirable alkyl glycoside is that represented by the following formula (I):

$$R_1(OR_2)xGy \qquad (I)$$

wherein $R_1$ is a linear or branched, alkyl, alkenyl, or alkylphenyl group having 8–18 carbon atoms, $R_2$ is an alkylene group having 2–4 carbon atoms, G is a residual group of a reducing sugar having 5–6 carbon atoms, x is a mean value of 0–5, and y is a mean value of 1–10.

Alkyl glycoside compounds having 10–14 carbon atoms for $R_1$ in the formula (I) are preferable from the aspect of good solubility, foaming power, and detergency.

For $R_2$ of formula (I), compounds having an alkylene group of a 2–4 carbon atom content, especially of a 2–3 carbon atom content, are preferable in view of their good water solubility.

G in formula (I), which is a residual group of a reducing sugar having a 5–6 carbon atom content, depends for its structure on the sugar from which it is derived, i.e., on whether the sugar is mono- or polysaccharide. Given as examples of monosaccharides are glucose, fructose, galactose, xylose, mannose, lixysose, arabinose, and their mixtures. Polysaccharides may be maltose, xylobiose, isomaltose, cerobiose, gentibiose, lactose, sucrose, nigerose, turanose, raffinose, gentianose, merezitose, and their mixtures. Among monosaccharides, glucose and fructose are desirable in view of their ready availability and low cost. Maltose and sucrose are preferable among the polysaccharides.

Although x may be a mean value of 0–5, a mean value for x of 0–2 is more desirable. Water solubility and crystallization characteristics of component (a) are dependent on this mean value. The greater the mean value, the higher is the water solubility and the smaller is the tendency that component (a) crystallizes.

y is a mean value of 1–10, with a more preferable range being 1.0–3.0, and an especially preferable range being 1.1–1.45. When the mean value y is in these ranges, the (b) component, which is a foaming agent hereinafter discussed, can exhibit a satisfactory effect at a smaller content.

In case the mean value y is larger than 1, i.e., when alkyl glycoside comprises compounds of formula (I) having di- or polysaccharide chains as hydrophilic groups, the component (a) can be a mixture of compounds having various types of saccharide bond, including 1-2, 1-3, 1-4, 1-6, α-pyranoside, β-pyranoside bonds, and furanoside.

It is desirable that component (a) be contained in the detergent composition in an amount of 1–60% by weight, and preferably 10–40% by weight.

Component (b), a dicarboxylic acid type surface active agent, is selected from the compounds represented by formulae (II), (III), (IV), or (V). From the aspect of ensuring stability and the like of the detergent composition, a dicarboxylic acid type surface active agent of formula (II) is especially preferable.

One type or a mixture of two or more types of these compounds can be used as the (b) component.

The (b) component, when formulated to a detergent composition comprising alkyl glycoside, the (a) component of the present invention, acts so as to reduce irritation to the skin, to promote detergency and foaming power, and at the same time, brings about improved rinse-out performance and better feeling to the hands during washing.

In order for the (b) component to exhibit such effects, it is desirable that the component be formulated in the detergent composition of the present invention in an amount of 0.05–5% by weight, and especially preferably in an amount of 0.1–3% by weight.

A ratio by weight of components (b)/(a) used in the detergent composition of the present invention is in the range of 1/600–1/1. A preferable range of the ratio (b)/(a) is 1/300–3/5, with the most preferable range being 1/100–1/2. The amount of component (a) plus component (b) in the detergent composition is in the range of 1–60% by weight.

Beside the above essential components, various known surface active agents can be formulated into the detergent composition of the present invention as desired in order to promote its foaming power and detergency. Such known surface active agents may be nonionic surface active agents, e.g. polyoxyethylene (average EO=4–20) alkyl ($C_7$–$C_{18}$, linear or branched) ethers, higher fatty acid ($C_3$–$C_{22}$) mono- or dialkanol ($C_2$–$C_3$) amides, tertiary alkyl ($C_8$–$C_{18}$, linear or branched) amine oxides, etc.; anionic surface active agents, e.g. α-olefin ($C_8$–$C_{20}$) sulfonates [Na, K, Mg, triethanolamine (TEA), $NH_4$], polyoxyethylene (average EO=2–8) alkyl($C_8$–$C_{18}$, linear or branched)sulfates (Na, K, Mg, TEA, $NH_4$), salts of α-sulfo fatty acid ester of the formula:

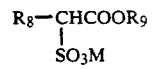

(wherein $R_8$ is $C_8$–$C_{18}$ and $R_9$ is $C_1$–$C_4$, and M is an alkali metal), N-acyl ($C_8$–$C_{18}$) glutamates (Na, K, TEA), monoalkyl ($C_8$–$C_{18}$) phosphates (Na, K, TEA, arginine), linear alkyl ($C_{10}$–$C_{18}$) benzenesulfonates (Na, K, Mg), etc.; and amphoteric surface active agents, e.g. alkylbetaine, alkylsulfobetaine, etc.

In addition, other optional components can be added to the detergent composition of the present invention to the extent they do not impair the stability, detergency, and foaming power of the detergent composition. Such optional components include lower aliphatic alcohols, e.g. ethanol and the like; solubilizing agents, e.g. sodium or potassium toluenesulfonic acid or xylenesulfonic acid, urea, and the like; viscosity adjusting agents, e.g. clay minerals, water-soluble polymers, and the like; water-insoluble abrasives, e.g. calcite, silica, calcium phosphate, zeolite, polyethylene, nylon, polystyrene, and the like; moisturizing agents, e.g. glycerol, sorbitol, and the like; sensation improving agents, e.g. cationized cellulose, and the like; as well as enzymes, perfumes, coloring agents, preservatives, antifungal agents, and the like.

The pH range of the detergent composition of the present invention is between 4 and 10, with an especially preferable pH range being between 5 and 8.

The detergent composition of the present invention exhibits superior detergency and excellent foaming power. It is mild to the skin causing no or very little roughening of the hands. The detergent composition possesses improved rinse-out performance and imparts better feeling to the hands during washing.

Other features of the invention will become apparent in the course of the following description of the exemplary embodiments which are given for illustration of the invention and are not intended to be limiting thereof.

EXAMPLES

Test Methods and Standard of Evaluation (1) Foaming Capability

Foaming power was measured using a 0.5% solution of a detergent composition to which 0.1% of commercially available butter was added as a dirt component. 40 ml of this solution was placed in a glass cylinder with a 5 cm diameter and was stirred for 10 minutes. Height of the foam produced was measured immediately after termination of the stirring.

(2) Detergency

Beef tallow to which 0.1% of Sudan III (red color pigment) was added as an indicator was used. 2.5 g of the beef tallow was applied onto each porcelain dish with a 25 cm diameter. The dishes were then rubbed at a temperature of 20° C. with a sponge into which 3 g of a detergent composition and 27 g of water (hardness: 3.5° DH) were absorbed. The number of dishes of which beef tallow dirt could be removed with the sponge was taken as the detergency of the detergent composition.

(3) Rinse-out Performance 3 liters of a 0.25% solution of a sample detergent composition was charged into a vat with a diameter of 30 cm, 12 cm deep, and stirred for 10 minutes to produce foam. The liquid was discharged from a cock at the bottom of the vat. 3 liters of city water were then charged to the vat and stirred for 10 minutes. The liquid was discharged again. This same procedure was repeated until no foam was observed in the vat after the discharge of the liquid. The number of times required to charge 3 liters city water and to discharge the liquid until no residual foam was observed was taken as a standard for the rinse-out performance of a detergent composition.

(4) Hand sensation during and after use

Two detergent compositions A and B were provided for the test. Detergent solutions of 10% concentration was prepared from each detergent composition. They were charged into 2 liter beakers at 40° C. and sensation of the detergent compositions was evaluated according to the following standard:

(i) Sensation during use

The subject immersed right and left hands separately into either the detergent solution A or the detergent solution B, and after 1 minute the sensation to the hands of Detergent B in relation to Detergent A was evaluated and rated according to the following criteria:

| | |
|---|---|
| Detergent B is less slippery | +2 |
| Detergent B is slightly less slippery | +1 |
| Cannot tell which is more slippery | ±0 |
| Detergent B is slightly more slippery | −1 |
| Detergent B is more slippery | −2 |

(ii) Sensation after use

After the detergent was thoroughly rinsed away, the hands were wiped with towel. Then, the sensation to the hands of Detergent B in relation to Detergent A were evaluated and rated according to the following criteria:

| | |
|---|---|
| Detergent B is less sticky | +2 |
| Detergent B is slightly less sticky | +1 |
| Cannot tell which is more sticky | ±0 |
| Detergent B is slightly more sticky | −1 |
| Detergent B is more sticky | −2 |

The above tests were performed on the ten subjects. The sensation imparted by Detergent B was assessed by the sum of the ratings obtained in the above tests (i) and (ii). (5) Hand roughness test A solution containing 5% by weight of the detergent composition was prepared. The subjects' hands were dipped in the solution for 20 minutes at the solution temperature of 30° C. every day for consecutive 3 days. The conditions of the hands of the 5 subjects were observed by the naked eye on the fourth day and rated according to the following criteria. The results were shown by the mean value of the rating. A mean value 4 or more is desirable in this test.

| | |
|---|---|
| No roughening on the hands was observed | 5 |
| Roughening was very slight | 4 |
| Roughening was observed but not considerable | 3 |
| Considerable roughening was observed | 2 |
| Roughening was remarkable | 1 |

EXAMPLE 1

Compositions shown in Table 1 were prepared, and their forming power, detergency, rinse-out performance, hand sensation during and after the use, and hand roughening were evaluated for each composition. The results are presented in Table 1.

In the evaluation tests, Comparative Product No. 10 was used as Detergent A for comparison of performances of Detergent B (Invention Product Nos. 1–7 and Comparative Product Nos. 8–9).

TABLE 1

| | | | | | | % by weight | | | | | | | | | |
|---|---|---|---|---|---|---|---|---|---|---|---|---|---|---|---|
| | | | | | | Invention Product Nos. | | | | | | | Comparative Product Nos.* | | |
| | | | | | | 1 | 2 | 3 | 4 | 5 | 6 | 7 | 8 | 9 | 10 |
| Components | | | | | | | | | | | | | | | |
| Component (a) | $R_1$ | y | | | | | | | | | | | | | |
| Alkyl glycoside: | $C_9$-$C_{11}$ alkyl | 1.2 | | | | 23 | 23 | 23 | | | | 23 | 23 | | 23 |
| (I) $R_1(OR)_2)_xG_y$, x = 0, | | | | | | | | | | | | | | | |
| G = glucose residue | $C_9$-$C_{11}$ alkyl | 1.4 | | | | | | | 23 | 23 | 23 | | | 12 | |
| Component (b) | $R_3$ | n | m | $M_1$ | $M_2$ | | | | | | | | | | |

TABLE 1-continued

| | | | | | | Invention Product Nos. | | | | | | | % by weight Comparative Product Nos.* | | |
|---|---|---|---|---|---|---|---|---|---|---|---|---|---|---|---|
| | | | | | | 1 | 2 | 3 | 4 | 5 | 6 | 7 | 8 | 9 | 10 |
| (II) $R_3-CH(COOM_1)-CH_2(COOM_2)$ | $C_{12}H_{22}$ (unsaturated) | — | — | K | H | 3 | | | | | | | 0.01 | | |
| | $C_8H_{17}$ | — | — | Na | H | | 3 | | | | | | 15 | | |
| (III) $R_3-CON(R_4COOM_1)(R_5COOM_2)$ | $C_{12}H_{25}$ | 0 | 2 | H | Na | | | 3 | | | | | | | |
| ($R_4$, $R_5$: $-(CH_2CH_2O)_n-(CH_2)_m$) | $C_{12}H_{25}$ | 0 | 2 | H | TEA | | | | 4 | | | | | | |
| (IV) $R_3-N(R_4COOM_1)(R_5COOM_2)$ | $C_{14}H_{29}$ | 3 | 1 | H | H | | | | | 4 | | | | | |
| ($R_4$, $R_5$: $-(CH_2CH_2O)_n-(CH_2)_m$) | $C_8H_{17}$ | 1 | 2 | Na | H | | | | | | 4 | | | | |
| 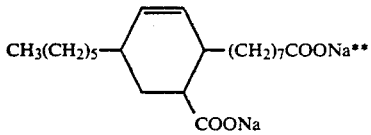 | | | | | | | | | | | | 3 | | | |
| Water | | | | | | Balance | " | " | " | " | " | " | " | " | " |
| Detergent performance | | | | | | | | | | | | | | | |
| Detergency (number of dishes) | 7 | 7 | 7 | 7 | | 7 | 7 | | 7 | | 5 | | 1 | 5 | |
| Foaming power (mm) | 92 | 90 | 91 | 90 | | 90 | 90 | | 90 | | 20 | | 0 | 11 | |
| Rinsing performance (times) | 5 | 5 | 5 | 5 | | 5 | 5 | | 5 | | 8 | | 6 | 8 | |
| Hand sensation | | | | | | | | | | | | | | | |
| During use | +9 | +8 | +8 | +8 | | +8 | +8 | | +8 | | +0.5 | | −0.3 | ±0 | |
| After use | +11 | °11 | +10 | +10 | | +10 | +10 | | +10 | | +0.5 | | −0.3 | ±0 | |
| Hand Roughening | 4.7 | 4.6 | 4.6 | 4.7 | | 4.6 | 4.6 | | 4.5 | | 4.2 | | 3.0 | 4.1 | |

*No component (b) compound was formulated to Comparative Products.
**Diacid 1550 (Trade name: product of Westbaco Co.)

EXAMPLE 2

| Liquid detergent for clothing | |
|---|---|
| Alkyl glycoside [1] | 20% by weight |
| Polyoxyethylene (P = 7) laurylether | 20 |
| Potassium dodecenyl succinate | 3 |
| Sodium citrate | 2 |
| Ethanol | 3 |
| Perfume | Small amount |
| Enzyme | Small amount |
| Fluorescent dye | Small amount |
| Water | Balance |
| | 100 |

pH = 10
[1] Alkyl glycoside: $R_1(OR_2)_xG_y$
x = 1, y = 1.35, $R_1$ = $C_{10}$-$C_{13}$, $R_2$ = $C_2$
G = Glucose residue

EXAMPLE 3

| Liquid detergent for use with household articles | |
|---|---|
| Alkyl glycoside [2] | 6.0% by weight |
| Dicarboxylic acid surfactant [3] | 0.5 |
| Special type carboxylic acid high molecular surfactant [4] | 5.0 |
| Triethanolamine | 1.0 |
| Ethanol | 3.0 |
| Perfume | Small amount |
| Coloring agent | Small amount |
| Water | Balance |

-continued

| Liquid detergent for use with household articles |
|---|
| 100 |

pH = 10.5
[2] Alkyl glycoside: $R_1(OR_2)_xG_y$
x = 0, y = 1.2, $R_1$, $R_2$ = $C_9$-$C_{12}$
G = Glucose residue
[3] Diacid 1550 (Trade name: product of Westaco Co.)
[4] Poise 530 (Trade name: product of Kao Corp.)

Obviously, numerous modifications and variations of the present invention are possible in light of the above teachings. It is therefore to be understood that within the scope of the appended claims, the invention may be practiced otherwise than as specifically described herein.

What is claimed is:

1. A detergent composition consisting essentially of:
(a) an alkyl glycoside,
(b) one or more dicarboxylic acid surface active agents of the following formulae (II), (III), (IV), and (V):

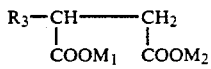
(II)

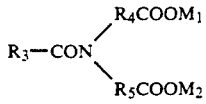
(III)

-continued

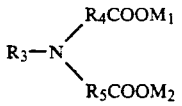

(IV)

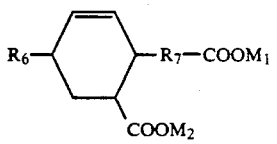

(V)

wherein $R_3$ is a linear or branched, alkyl or alkenyl group having 8–16 carbon atoms, $R_4$ and $R_5$ each individually represents a group $-(CH_2CH_2O)_n-(CH_2)_m$ (m is a value of 1–5 and n is a value of 0–5), $R_6$ is an alkyl group having 3–12 carbon atoms, $R_7$ is an alkylene group having 1–12 carbon atoms, provided that the total carbon atom content in $R_6$ and $R_7$ groups is 6–22, and $M_1$ and $M_2$ each individually represents a hydrogen atom, an alkali metal, an alkaline earth metal, or an alkanolamine; and wherein the ratio (b)/(a) by weight is 1/600–1/1 and the content of components (a) and (b) is 1–60% by weight; (c) water; and (d) one or more additives selected from the group consisting of surface active agents, lower aliphatic alcohols, solubilizing agents, moisturizing agents, perfumes, coloring agents, preservatives and antifungal agents.

2. A detergent composition according to claim 1, wherein the alkyl glycoside is compound represented by the following formula (I):

$$R_1(OR_2)xGy \qquad (I)$$

wherein $R_1$ is a linear or branched, alkyl, alkenyl, or alkylphenyl group having 8–18 carbon atoms, $R_2$ is an alkylene group having 2–4 carbon atoms, G is a residual group of a reducing sugar having 5–6 carbon atoms, x is a mean value of 0–5, and y is a mean value of 1–10.

3. The detergent composition according to claim 2, wherein y in formula (I) is a mean value of 1.1 to 1.45.

4. The detergent composition according to claim 1, wherein said alkyl glycoside is contained in an amount of 10–40% by weight.

5. The detergent composition according to claim 1, wherein said dicarboxylic acid surface active agents are contained in an amount of 0.05–5% by weight.

* * * * *